US009829153B2

(12) United States Patent
Spencer et al.

(10) Patent No.: US 9,829,153 B2
(45) Date of Patent: Nov. 28, 2017

(54) COMPOSITE PRESSURE VESSEL AND METHOD OF CONSTRUCTION

(71) Applicants: Zachary Spencer, Sacramento, CA (US); Brian Spencer, Sacramento, CA (US)

(72) Inventors: Zachary Spencer, Sacramento, CA (US); Brian Spencer, Sacramento, CA (US)

(73) Assignee: SPENCER COMPOSITES CORPORATION, Sacramento, CA (US)

( * ) Notice: Subject to any disclaimer, the term of this patent is extended or adjusted under 35 U.S.C. 154(b) by 55 days.

(21) Appl. No.: 14/490,380

(22) Filed: Sep. 18, 2014

(65) Prior Publication Data

US 2016/0084437 A1 Mar. 24, 2016

(51) Int. Cl.
*F17C 1/06* (2006.01)

(52) U.S. Cl.
CPC ..... *F17C 1/06* (2013.01); *F17C 2201/0119* (2013.01); *F17C 2203/0604* (2013.01); *F17C 2203/0636* (2013.01); *F17C 2203/0658* (2013.01); *F17C 2203/0663* (2013.01); *F17C 2203/0673* (2013.01); *F17C 2209/227* (2013.01); *F17C 2209/234* (2013.01); *F17C 2270/0781* (2013.01)

(58) Field of Classification Search
CPC ..... B65D 90/545; F16J 13/00; F16J 13/02; F17C 1/06; F17C 13/06; F17C 13/02; F17C 2205/0308
USPC ..... 220/581–582, 586, 589–590
See application file for complete search history.

(56) References Cited

U.S. PATENT DOCUMENTS 4,560,232 A * 12/1985 O'Hara ..... B01J 3/002 220/288
4,739,899 A * 4/1988 Thompson ..... F16J 15/062 220/240
5,193,703 A * 3/1993 Staats, III ..... B01D 11/0203 210/198.2
5,429,845 A * 7/1995 Newhouse ..... F17C 1/16 138/30
5,758,796 A * 6/1998 Nishimura ..... F17C 1/06 220/590
5,938,209 A * 8/1999 Sirosh ..... F17C 13/06 220/495.08
5,979,692 A * 11/1999 West ..... F17C 1/16 220/586
6,089,399 A * 7/2000 Felbaum ..... B32B 15/013 220/582
2003/0189053 A1* 10/2003 Felbaum ..... F17C 1/02 220/582
2012/0024746 A1* 2/2012 Otsubo ..... F17C 13/06 206/524.3
2012/0085758 A1* 4/2012 Svensson ..... B30B 11/002 220/4.26
2012/0205337 A1* 8/2012 Holbach ..... F17C 13/06 215/40

* cited by examiner

*Primary Examiner* — Robert Poon
(74) *Attorney, Agent, or Firm* — Squire Patton Boggs (US) LLP

(57) ABSTRACT

A pressure vessel comprising a pipe closed at each end with a novel plug/compression cap, the plug at one end of the pipe having a port for connection to a pressure regulating device.

21 Claims, 11 Drawing Sheets

COMPOSITE PRESSURE VESSEL AND METHOD OF CONSTRUCTION

FIELD OF THE INVENTION

This invention relates to a pressure vessel comprising a composite tube sealed at both ends with an internal plug and an external compression cap and to methods of fabricating them.

BACKGROUND OF THE INVENTION

Current high performance cylindrical pressure vessels generally have domed ends, which engenders a number of design and fabrication complexities. For one, such pressure vessels are not scalable. That is, it is not possible to transition from a first volume/pressure condition to a second volume/pressure condition by simply applying a proportionality multiplier to the dimensions of the domed end used in the one condition to arrive at proper dimensions of the domed end under the other condition. Rather, complex design and fabrication factors come into play that must be addressed ab initio.

Further, when a domed pressure vessel comprises a composite overwrap, a minimum of a three axis and preferably a four-axis filament winding is required. The third axis is a radial (cross-feed) axis perpendicular to carriage travel and the fourth axis is a rotating fiber payout head mounted to the cross-feed axis and is used to stop the fiber band from twisting and thereby varying band width during winding. Three and four axis winders are complicated and expensive.

In addition, when liners for conventional domed pressure vessels are fabricated, they are —usually spin formed or roto-molded. This limits the type of materials that can be used to make the vessel.

Finally, pressure vessels currently in use for SCBA (Self-Contained Breathing Apparatus—used by first responders, etc.) or SCUBA (Self-Contained Underwater Breathing Apparatus—used for diving) applications, although relatively small, still generally have at least one domed end and must conform to the same design and fabrication requirements as large domed vessels, which results in their being heavy, cumbersome and relatively expensive.

What is needed, particularly with regard to small volume pressure vessels such as those for SCBA and SCUBA, is a scalable design that can be easily fabricated in a broad range of volume/pressure configurations, that does not require a dome at either end, and that, by virtue of these and other features, is relatively light in weight, easy to fabricate and inexpensive. In addition, it would be desirably if the pressure vessels had a relatively small profile which would facilitate use in confined spaces. The present invention provides such a pressure vessel.

SUMMARY OF THE INVENTION

Thus, in one aspect the present invention relates to a pressure vessel, comprising:

a pipe having a proximal end, a distal end, a cylindrical section comprising a two-axis wound filamentous composite, a wall that defines a bore, the bore having an inside diameter in the cylindrical section, and a length that, together with the inside diameter, defines a volume, and the pipe having an outer surface; wherein each end of the pipe is inwardly tapered such that the diameter of the bore at each end of the pipe is smaller than the inside diameter;

a plug in the bore at each end of the pipe, each plug comprising a cylindrical section at its proximal end, the cylindrical section being innermost in the bore and contiguous with the cylindrical section of the wall of the pipe and an inwardly tapered section that is contiguous with the wall of the tapered section of the pipe, the tapered section of the plug terminating in a surface located at or near the end of the pipe; wherein:

the cylindrical section of the plug includes a circumferential groove in which is disposed a seal;

a compression cap at each end of the pipe, each compression cap having an inner surface, and each compression cap comprising a cylindrical section that is disposed over and contiguous with a portion of the outer surface of the cylindrical section of the pipe and a tapered section, the inner surface of the tapered section of the compression cap being contiguous with the outer surface of the tapered section of the pipe; wherein at least one of the plugs comprises a threaded port for fluid ingress and egress.

In an aspect of this invention, the angle at which the filamentous composite is wound is about 5° to about 85° in relation to a center line of the pipe.

In an aspect of this invention, the angle at which the filamentous composite is wound is about 20° to about 85°.

In an aspect of this invention, the pipe comprises a liner.

In an aspect of this invention, the liner comprises a material selected from the group consisting of a thermoplastic polymer, a thermoset polymer, a ceramic, a metal and combinations of these.

In an aspect of this invention, the liner comprises a metal.

In an aspect of this invention, the metal liner has been subjected to autofrettage.

In an aspect of this invention, the distal end of the plug comprises a flange extending orthogonally outward from a centerline of the plug for a distance that is the same or slightly less than the thickness of the wall of the pipe In an aspect of this invention, the taper of the plug and of the compression cap is inward at an angle of 5° to 45°.

In an aspect of this invention, the taper of the plug and of the compression cap is inward at an angle of approximately 10°.

In an aspect of this invention, the inside diameter of the pipe, is 18 inches or less.

In an aspect of this invention, the insider diameter of the pipe is 6 inches or less.

In an aspect of this invention, the filamentous composite comprises a filament elected from the group consisting of a glass filament, a ceramic filament, a carbon filament, an aramid filament, a natural filament, an ultra-high molecular weight polyethylene filament and combinations thereof.

In an aspect of this invention, the filamentous composite comprises a matrix polymer.

In an aspect of this invention, the matrix polymer is a thermoset polymer.

In an aspect of this invention, the thermoset polymer is selected from the group consisting of epoxy resins, polyester resins, vinyl ester resins, polyimide resins, a dicyclopentadiene resin and combinations thereof.

In an aspect of this invention, the plug is fabricated of a material selected from the group consisting of a metal, an alloy, a polymer, a polymeric composite and a combination of these.

In an aspect of this invention, the cylindrical surface, the tapered surface or both the cylindrical and tapered surface of the plug is knurled.

In an aspect of this invention, there is an adhesive layer between the cylindrical surface of the plug and the inner surface of the bore of the pipe.

In an aspect of this invention, the compression cap is fabricated of a material selected from the group consisting of a metal, an alloy, a polymer, a polymeric composite and a combination of these.

An aspect of this invention is a method of fabrication of a pressure vessel, comprising:

fabricating a pipe stock having a length that together with an inside wall diameter of the bore of the pipe stock is at least that required to achieve a desired final volume pressure vessel, wherein:

the pipe stock comprises a two-axis wound filamentous composite formed on and then removed from a template, or the pipe stock comprises a two-axis filamentous composite wound liner;

if the pipe length is longer than required to achieve the desired final volume pressure vessel, cutting a length of the pipe stock, which length together with the bore defines the desired volume;

notching a section of the length of pipe at each end;

inserting into the bore at each end of the pipe a plug, the plug comprising a cylindrical section that is inserted first into the length of pipe and that is contiguous with the wall of pipe bore and that has groove in its outer surface in which has been placed a seal, and a inwardly tapered section that terminates at a distal end of the plug in a surface, the plug being inserted into the pipe until the tapered section is adjacent the notched section of the pipe;

force-fitting a compression cap over the notched section of the pipe, the compression cap comprising an inner surface having the same taper as that of the tapered section of the plug wherein the taper of the compression cap forces the notched section of the pipe to bend inwardly until the inner surface of the bore is contiguous with the tapered surface of the plug; wherein:

at least one of the plugs further comprises a port for coupling with an external fluid ingress/egress device.

In an aspect of this invention, in the above method, edges of the notches are straight.

In an aspect of this invention, in the above method, edges of the notches are convex.

In an aspect of this invention, in the above method a layer of adhesive is disposed between the cylindrical surface of the plug and the wall of the bore.

In an aspect of this invention, the cylindrical section, the tapered section or both the cylindrical and the tapered sections of the plug are knurled.

In an aspect of this invention, the plug comprises a flange at the distal end of the tapered section, which flange is contiguous with a thickness of a wall of the pipe when the plug is inserted into the end of the pipe.

In an aspect of this invention, the fluid comprises a gas, a liquid or a combination of these.

DETAILED DESCRIPTION OF THE INVENTION

Brief Description of the Figures

The figures are provided for illustrative purposes only to assist in understanding the invention herein and are not intended nor should they be construed as limiting the scope of this invention in any manner.

It is further noted that, in some of the figures, surfaces of the various components are shown spaced apart while the description of them states that they are contiguous, that is, in contact with one another. It is understood that such surfaces are shown spaced apart simply for the purpose of making it easier to see and understand the relationship between them.

FIG. 3 is inserted into a composite cylinder of FIG. 1 a compression cap is force-fitted over the outer surface of the composite cylinder which causes a section of the composite cylinder to bend at the apex of the notches to conform to the taper of the plug and the compression cap.

DISCUSSION

Figure 1A:
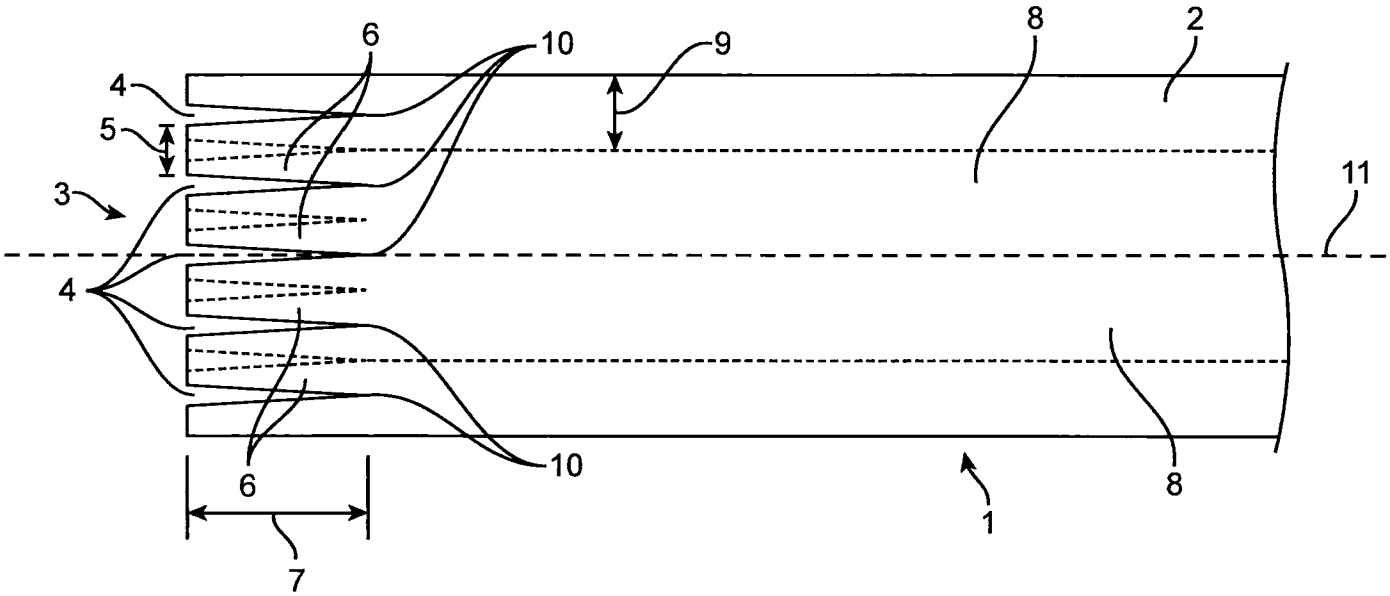
FIG. 1A illustrates an end section of a pipe that comprises the primary volume containment portion of a pressure vessel of this invention.

It is understood that, with regard to this description and the appended claims, any reference to any aspect of this invention made in the singular includes the plural and vice versa unless it is expressly stated or unambiguously clear from the context that such is not intended.

As used herein, any term of approximation such as, without limitation, near, about, approximately, substantially, essentially and the like, means that the word or phrase modified by the term of approximation need not be exactly that which is written but may vary from that written description to some extent. The extent to which the description may vary will depend on how great a change can be instituted and have one of ordinary skill in the art recognize the modified version as still having the properties, characteristics and capabilities of the word or phrase unmodified by the term of approximation. In general, but with the preceding discussion in mind, a numerical value herein that is modified by a word of approximation may vary from the stated value by ±10%, unless expressly stated otherwise.

As used herein a "seal" refers to a device that helps to join components together to form a fluid-tight interface so as to prevent leakage from the joined components. For the purposes of this invention, a seal can comprise, without limitation, an O-ring seal, a lip seal, a cup seal, a V-seal, a bore seal or a face seal.

The terms "proximal" and "distal" simply refer to the opposite ends of a construct and are used as a method of orienting an object with relation to another object such as the orientation of the ends of a plug herein in relation to a composite cylinder when the plug is inserted into the bore of the cylinder. In general, which end is designated as proximal and which as distal is purely arbitrary unless the context unambiguously expresses otherwise.

As used herein, "contiguous" refers to two surfaces that are adjacent and that are in direct contact or would be in direct contact were it not for an intervening layer of another material. For example, without limitation, a plug surface would be contiguous to a composite surface of this invention if there is nothing interspersed between the plug surface and the composite surface but also would be considered contiguous if a layer of adhesive were to be placed between the two surfaces.

As used herein, the use of "preferred," "presently preferred," "preferably," or "more preferred," and the like refers to preferences as they exist at the time of filing of this application.

As used herein, a pressure vessel refers to a hollow primarily cylindrical construct wherein the hollow section of the construct can be fully isolated from the external environment and the material of which the vessel is fabricated is impermeable to a fluid contained in the vessel under pressures from atmospheric to in excess of 10,000 psi.

As used herein, a "pipe" simply refers to that construct that is well-known to those skilled in the art, that is, a hollow cylinder having a wall having an outer surface that defines an outside diameter, an inner surface that defines an inside diameter and a wall thickness between the two surfaces. The hollow inner region of the pipe is referred to as the "bore." For the purposes of this invention, the wall of the cylinder may comprise a single material, usually a composite, or it may comprise two or more layers, wherein the outermost layer is generally a composite or a protective layer over a composite layer and the innermost layer comprise a liner that separates the composite layer from the fluid contained in the pressure vessel.

As used herein, a "pipe stock" refers to a length of composite pipe that is at least as long as that needed to fabricate a pressure vessel of a desired capacity but is presently preferred to be substantially longer—how much longer depending primarily on the capability of available equipment and manufacturing procedures. Using the methods of this invention, such a long composite pipe stock may be used to fabricate pressure vessels of substantially divergent capacities in a relatively easy and inexpensive manner.

As used herein, a "liner" refers to a layer of material that is contiguous with the inner surface of the composite layer of a pressure vessel pipe of this invention and that separates the composite layer from the fluid contained in the pressure vessel. For the purposes of this invention, a liner can be fabricated of any suitable material, suitability being related to the inertness of the material with regard to the fluid to be contained in the pressure vessel and to its impenetrability by the fluid. Suitable materials include, without limitation, polymers such as Teflon®, high molecular weight polyethylene or polydicyclopentadiene, metals, metal alloys and ceramics. If a metal liner is used, it may be subjected to autofrettage, a technique well-known to those skilled in the art and needing no further description here, to increase the fatigue tolerance of the metal.

As used herein, a "fluid" has its normal meaning, that is, technically: a continuous amorphous substance whose molecules move freely past one another and that has a tendency to assume the shape of a container into which it is placed. More concisely for the purposes of this invention a fluid comprises a gas or a liquid, wherein the liquid may be a compressed gas and combinations of these, that is, primarily a gas with some liquid, primarily a liquid with some gas or a compressed gas liquid with some gas. In particular, the gas may comprise any of a number of known breathing mixtures used by first-responders and divers, in the latter case technical divers as well as casual divers. Of course, any manner of gas or liquid that is currently stored in conventional pressure vessels may be contained in pressure vessels of this invention. This includes industrial gases such as, without limitation, acetylene, oxygen, nitrogen, hydrogen, helium, argon, liquefied natural gas (LPG) and compressed natural gas (CNG).

As used herein, a "composite" refers to two or more distinct but structurally complementary substances such as metals, ceramics, glasses and polymers that are combined to produce materials having structural properties, functional properties or both structural and functional properties not found in the individual components. A "polymeric composite" refers to a composite in which a fibrous or filamentous material is impregnated with or embedded in a polymeric matrix, the fibrous or filamentous material sometimes being referred to as the "filler".

As used herein, a "filamentous composite" refers to a composite comprised of long threads of a filler material that are impregnated with, embedded in, or both impregnated with and embedded in a matrix material.

As used herein, a "fibrous composite" refers to a composite comprised of short lengths of the thread described above; that is, a fibrous material can be considered a filamentous material that is cut into shorter lengths.

A matrix material of a polymeric composite of this invention can be, without limitation, an epoxy resin, a polyester resin, a vinyl ester resin, a polyimide resin, a dicyclopentadiene resin or a combination of resins.

Presently preferred are dicyclopentadiene polymers. As used herein, a "dicyclopentadiene resin" refers to a polymer that comprises predominantly, that is 95% or higher, dicyclopentadiene monomer. The remainder of the monomer content then would comprise other reactive ethylene monomers.

In general, any type of fibrous or filamentous material may be used to create the polymeric composites of this invention. Such materials include, without limitation, natural substances such as silk, hemp, flax, etc., metals, ceramics, basalt, and synthetic polymer fibers and filaments.

Presently preferred filamentous filler materials include glass fibers, commonly known as fiberglass, carbon fibers, aramid fibers, which go mostly notably under the trade name Keviar®, and ultra-high molecular weight polyethylene, such as Spectra® (Honeywell Corporation) and Dyneeva® (Royal DSM N.V.).

A pipe of this invention has an outer surface comprising a two-axis wound filamentous composite. Two-axis winding is well-known in the art. Briefly, it requires a winding machine having two axes of motion, one axis being generally horizontal and parallel to the long axis of the pipe (the carriage travel axis) (see reference numeral 4 in FIG. 6A) and the other axis (the mandrel rotation axis) (see reference numeral 3 in FIG. 6A) winding the composite (see reference numeral 2 in FIG. 6A) around the pipe at a selected angle from the long axis. The winding angle may be slightly greater that zero, i.e. almost parallel to the long axis of the construct, to 90°. A 90° angle, often referred to as "hoop winding," will provide circumferential or "burst" strength while angles less than 90°, which result in helical winding, provide axial (longitudinal) strength. For the purposes of this invention, wind angles of about 10° to about 85°, preferable at present from about 30° to about 80° can be used to provide the desired axial and radial strength to a pressure vessel of this invention.

As used herein, a "plug" refers to a workpiece of size sufficient to fit into and tightly close off the bore of a pipe. A plug of this invention may close off a bore of a pipe completely or the plug may have a port that can be used to connect the internal volume of the pipe with the external environment, in which case the port is fitted with an ingress/egress device that can be opened or shut as desired to let fluid into or out of the pipe.

As used herein, a "surface" when describing the distal end of the tapered section of a plug of this invention means that the end of distal end comprises a topology that has an area as opposed to a point as would be the case if the tapered section was conical and ended in an apex. In essence the tapered section of a plug of this invention is a truncated cone as such is known in the art. The truncated surface may have any manner of shape and contour including, without limitation, planar, that is, essentially flat or it may be curved, including, without limitation, having a domed shape approximately like that of current conventional cylindrical pressure vessels. With regard to the use of domed plugs, it is understood that a clear advantage of the current invention is that the composite will still only be wound around the cylindrical portion of the pipe so that 3- and 4-axis winding machines will still not be required.

While any sort of ingress/egress device that is capable of controlling fluid movement and pressure into and out of a pressure vessel herein, a pressure regulator is presently preferred. A pressure regulator comprises a valve mechanism that controls the delivery of a fluid at a constant pressure. Generally, a pressure regulator lowers the pressure of the fluid to a usable level as the fluid passes from the pressure vessel to other equipment or, in the case of SCBA and SCUBA use, to a level usable for breathing. An ingress/egress device may be fitted to a port in a plug of this invention using any connection means known in the art but preferable at present the port in the plug is threaded as is the pressure regulator and the pressure regulator is simply screwed into the port.

As used herein, a "compression cap" refers to a workpiece that can be force-fitted over the ends of a pipe of this invention and can compress the end of the pipe inward to contact and conform with a tapered segment of a plug. The overall effect is to form a closure comprising a plug and a compression cap at the end of the pipe that can withstand the pressure exerted by a fluid contained in a pressure vessel of this invention.

As used herein, a "flange" refers to a construct as is generally known in the art; that is, a protruding rim, rib, edge or collar as on a pipe shaft used to strengthen an object, hold it in place, or attach it to another object. More specifically, a flange on a plug of this invention is used to hold the plug in place at the end of a pipe in which the plug has been inserted so as to make sure that the tapered section of the plug is properly aligned with the notched region of a pipe during fabrication of a pressure vessel of this invention.

As used herein, "knurled" refers to the result of any manner of roughening of a surface of a component of a pressure vessel of this invention, the purpose of the knurling being to enhance the adhesion of the surface to another surface with which the knurled surface is in contact by increasing friction between the surfaces.

An exemplary, non-limiting pressure vessel of this invention is illustrated in FIGS. 1-6.

FIG. 1A show a portion of a pipe 1 that comprises a pressure vessel of this invention. Since both ends of the pipe are treated in the same manner, it is only necessary to describe one end. The length of the pipe together with the inside diameter of the bore will be determined by the desired volumetric capacity of the pressure vessel being fabricated. The diagram shows wall 2 of the pipe as being single-walled, however, it is presently preferred that the wall comprises a liner inner layer that separates a composite over-layer from the fluid enclosed in the pressure vessel. End 3 of the pipe comprises notches 4, which are equidistantly spaced around the entire circumference of the pipe. The notches are cut completely through the wall of the pipe regardless of how many layers of material comprise wall 2. The number of notches and width 5 of the individual notches will determine the final diameter at end 3 of the pipe once petals 6 have been forced together and the notches closed by the combination of the tapered plug and corresponding tapered compression cap as mentioned previously herein and discussed below. The greater the number of notches and the greater width 5 is, the more petals 6 can be forced together and the smaller will be the diameter of the pipe at end 3. The distal end the plug will, of course, establish the diameter at end 3 of the pipe since the plug is inserted into the bore of pipe 1 until its distal end is substantially coplanar with end 3 of the pipe 1. At one end of the pipe, which as noted above is similarly notched at both ends, the diameter of the plug must be sufficient to incorporate a port for connecting the interior of the pressure vessel with the exterior environment.

The length 7 of the notches and the degree of inward taper that petals 6 achieve when the plug and compression rings are fully in place is determined by a number of factors. A primary factor is the maximum load that will be placed on the pipe/plug/compression cap assembly. The load is directly a function of the maximum pressure of a fluid that will be contained in the pressure vessel. The fluid will exert an axial load and a radial load on the wall of the vessel. How the vessel wall responds to that load depends in part on how the filamentous composite has been wound. That is, as the angle of the mandrel wind is changed from slightly greater than 0°, that is, essentially parallel with centerline 11 of the pipe, to 90°, perpendicular to centerline 11, the ability of the composite to accept axial versus radial load decreases until, at 90°, the composite will be able to control radial load only. In addition to pressure other factors that will affect the length and inward taper angle of petals 6 will also depend on the properties of the material(s) of which the pipe is fabricated. Among these factors are, without limitation, tensile strength of the wall materials, their ductility, the thickness of wall 2, in particular with regard to the diameter of the pressure vessel, which will change substantially as the notched section of pipe is compressed, the stress and strain on the materials and numerous other physical properties. Due to the large number of factors that must be considered, the method used to arrive at a final taper angle and petal length will generally involve finite element and parametric analyses. These mathematical analyses are complex but are well-understood by those skilled in the art and are in fact applied regularly to the design of current domed end pressure vessels. An advantage of the present invention is that once the calculations have been done the fabrication of appropriate plugs and compression caps is a relatively simple engineering exercise compared to the fabrication of a dome and the winding of the composite material requires only a two-axis device rather than the four axis device required for a domed pressure vessel. Based on the disclosures herein, those skilled in the art will be able to fabricate pressure vessels of virtually any capacity and pressure.

Figure 1B:
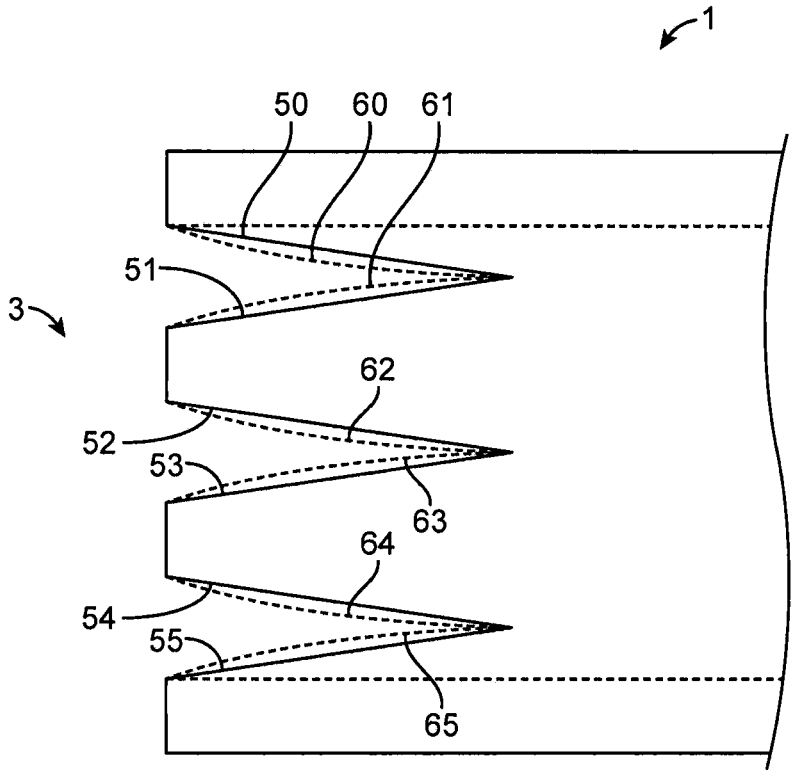
FIG. 1B is a closer view of notches in the end of the pipe showing straight-edge notches and slightly bowed or convex edges.

FIG. 1B shows an expanded view of end section 3 of pipe 1. Fewer notches are shown for clarity. In FIG. 1B a difference in the shape of the edges of notches 4 can be seen. In some embodiments, the edges are straight, edges 50, 51, 52, 53, 54 and 55. In another embodiment, the edges are slightly convex, edges 60, 61 62, 63, 64 and 65. The convex edges assure that when the notches are closed when a plug in inserted in the bore of the pipe and the compression cap is applied, the seal between the compressed edges is tight.

Figure 2:
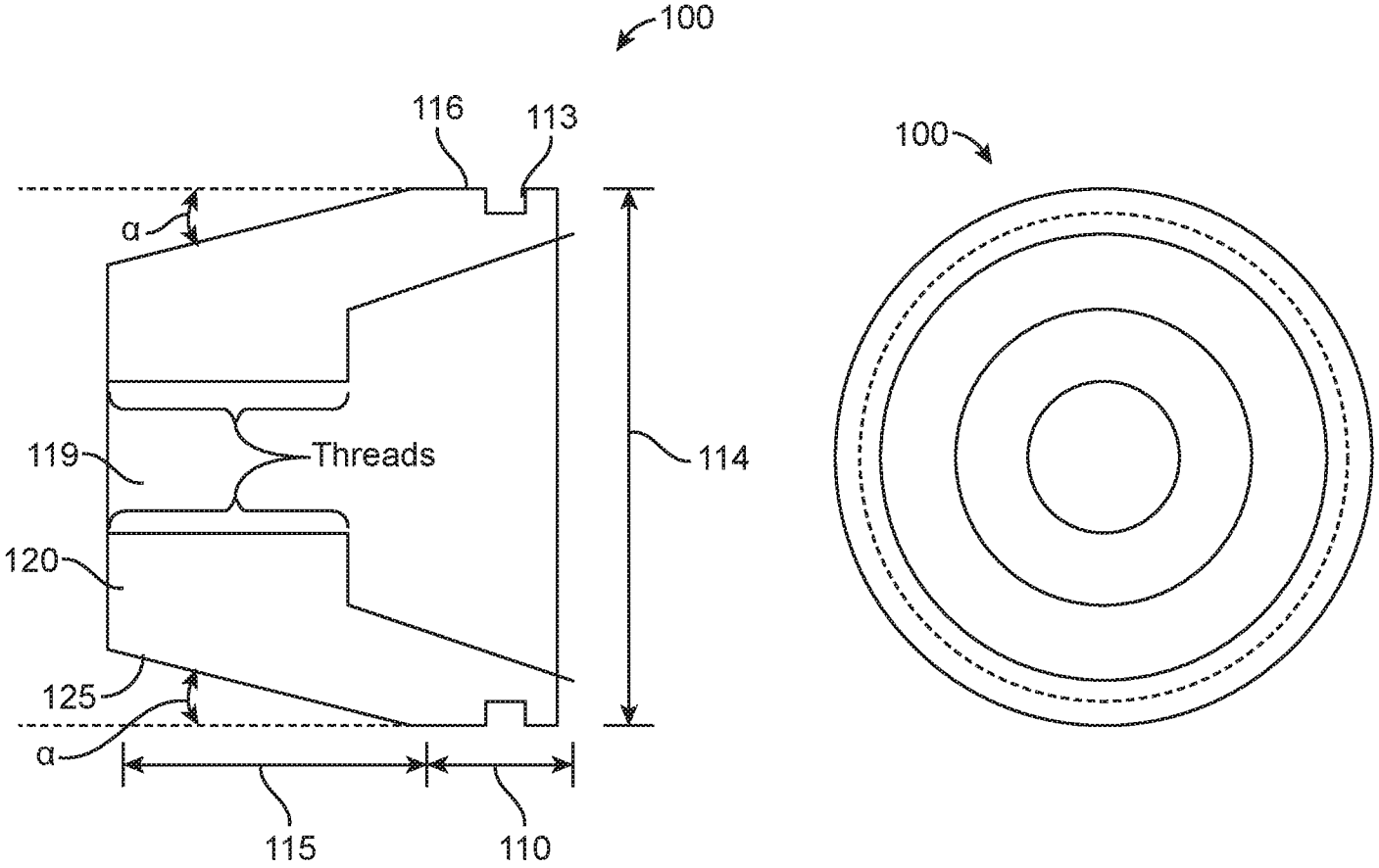
FIG. 2 illustrates a plug that is inserted into both ends of the pipe of FIG. 1A to create a wholly contained volume that constitutes a pressure vessel of this invention.

FIG. 2 shows plug 100 of this invention. Plug 100 comprises cylindrical section 110, inside diameter 114 of which is such that, when inserted into notched end 3 of pipe 1(FIG. 1A), the cylindrical section will fit tightly into bore 8 of pipe 1 such that outer surface 116 is contiguous with inner surface of the bore. Cylindrical section 110 further comprises groove 113, which is designed to accept a sealing element such as O-ring seal, a lip seal, a cup seal, a V-seal, a bore seal or a face seal. Plug 100 then comprises tapered section 115. Length 117 of tapered section 115 and angle $\alpha$ of the taper will depend on the previously discussed finite element and parametric analyses. Plug 100 is shown with threaded port 119 for coupling with a fluid ingress/egress control device. In general, it is necessary to have only one port so the assembly at the opposite end of the pipe will have a plug that is identical to that shown in FIG. 2 with the exception that port 119 is eliminated and the plug comprises a solid construct.

Figure 3:
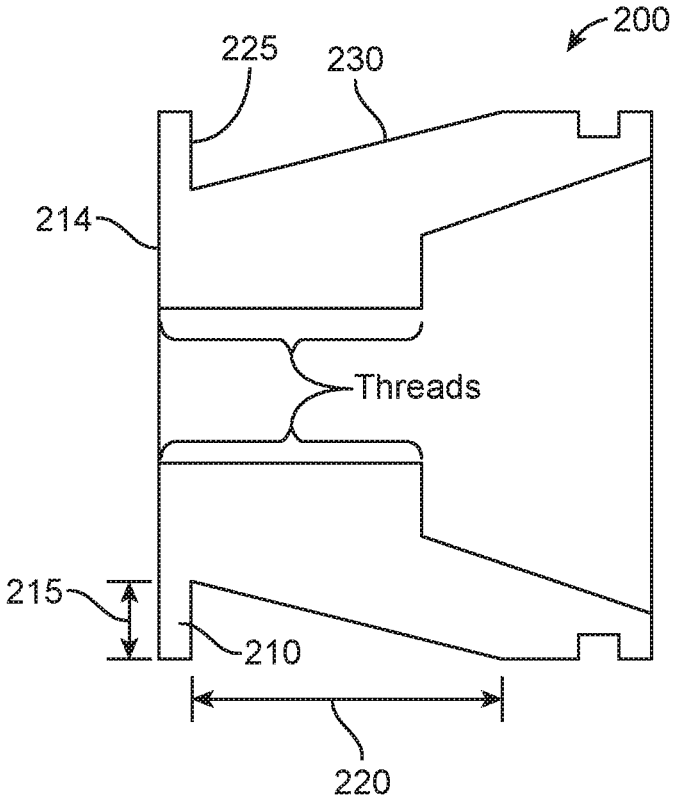
FIG. 3 illustrates a plug similar to that of FIG. 2 but with a flange at the distal end of the plug, which flange is used as a stop when the plug is inserted into a pipe.

FIG. 3 shows plug 200, which is essentially the same as plug 100 except for the presence of flange 210 at distal end 214 of plug 200. Length 215 of flange 210 is equal to or slightly less that thickness 9 of wall 2 (FIG. 1). Length 220 of tapered section 230 of plug 200 is substantially the same as length 7 of notches 4 in pipe 1. As discussed elsewhere herein, a feature of this invention is that petals 6 at end 3 of pipe 1 are forced inward by a compression cap that has a tapered surface that is inwardly tapered at the same angle $\alpha$ as tapered section 230 of plug 200. To accomplish this, petals 5 must bend at apex 10 of notches 4 (FIG. 1A) and it is therefore necessary that tapered section 230 of plug 200 (and the tapered section of plug 100) align with the length of notches 4. While this can be done by carefully inserting a plug into bore 8 of pipe 1 until distal end 120 of plug 100 is coplanar with the end 3 of pipe 1, the process can be simplified by flange 210. Plug 200 is inserted into bore 8 of pipe 1 until the flanges are approximately coplanar with end 3 of pipe 1. As a compression cap is forced onto pipe 1 and petals 5 begin their inward journey, thickness 9 of wall 2 will eventually be adjacent surface 225 of flange 210 at which time plug 200 can be adjusted such that thickness 9 of wall 2 is contiguous with surface 220 of flange 210, which will assure that plug 200 is properly positioned.

Figure 4:
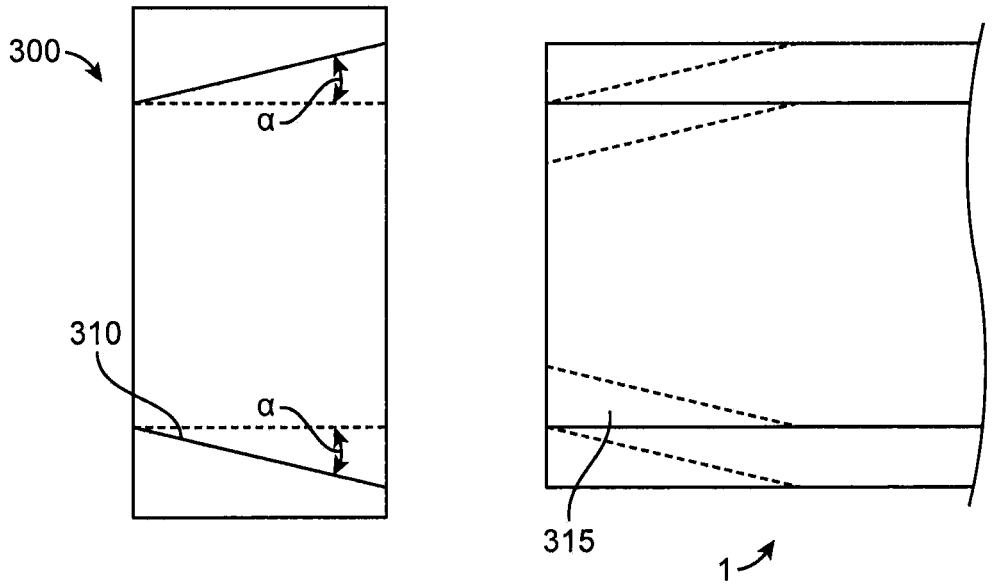
FIG. 4 illustrates a compression cap of the present invention, the compression cap having a taper at an angle $\alpha$ that is the same as the taper of the plug of FIGS. 2 and 3.

FIG. 4 shows compression cap 300, which has inner surface 310 that is tapered at the same angle $\alpha$ as surface 125 of plug 100. As shown in FIG. 4, when compression cap 300 is forced upon end 3 of pipe 1, a segment of pipe 1 is bent inward to position 315. Compression cap 300 can be a solid construct as shown in FIG. 4 or it can comprise two hemispherical sections that are placed over notched section of pipe 1 and then are brought together by application of force to the hemispheres.

Figure 5:
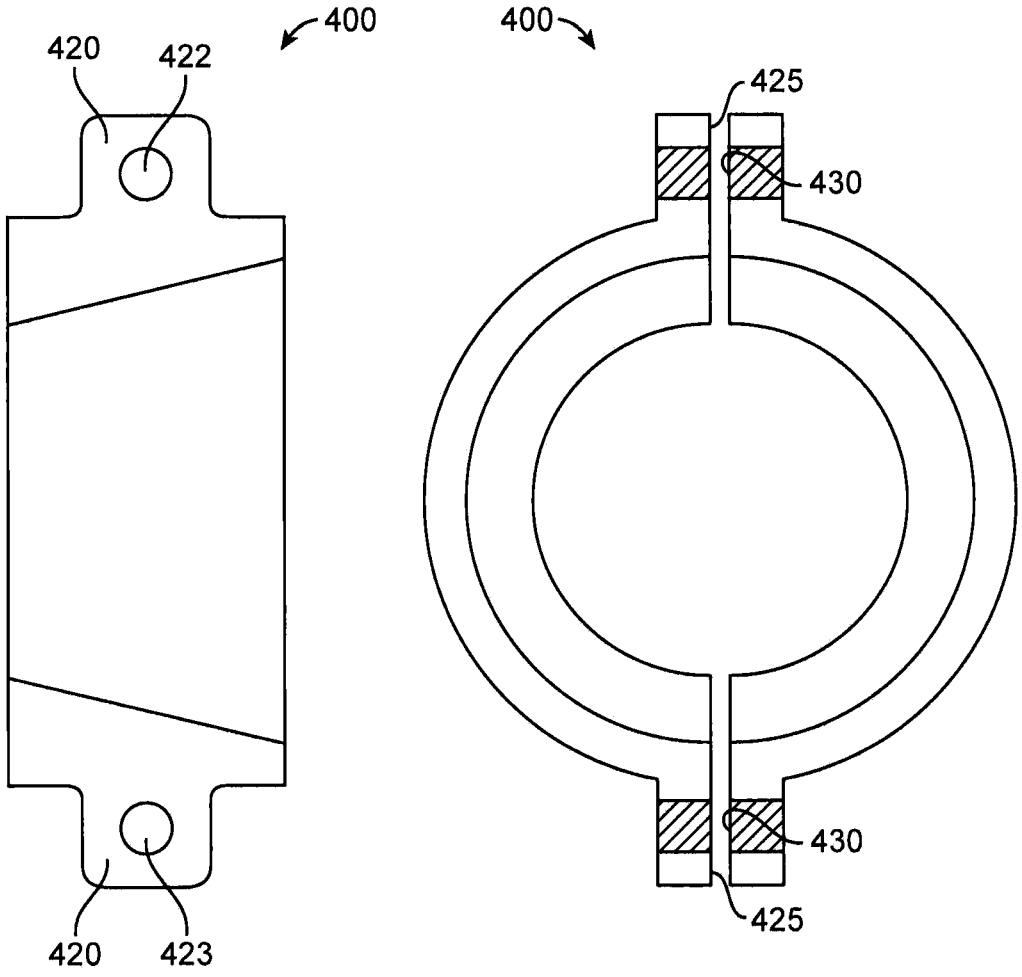
FIG. 5 illustrates an alternative construction of a compression cap of this invention, that is, the figure shows the cap a two hemispheric sections that can be bolted together to form the complete compression cap.

An exemplary hemispherical construct of compression cap is shown in FIG. 5. In FIG. 5, compression cap 400 is shown with flanges 420, which comprise threaded holes 422 and 423. The two hemispheres of compression cap 400 are placed on either side of notched pipe 1, bolts are inserted into holes 422 and 423 and the bolts are tightened down tightened down until surfaces 425 and 430 are contiguous.

Figure 6A:
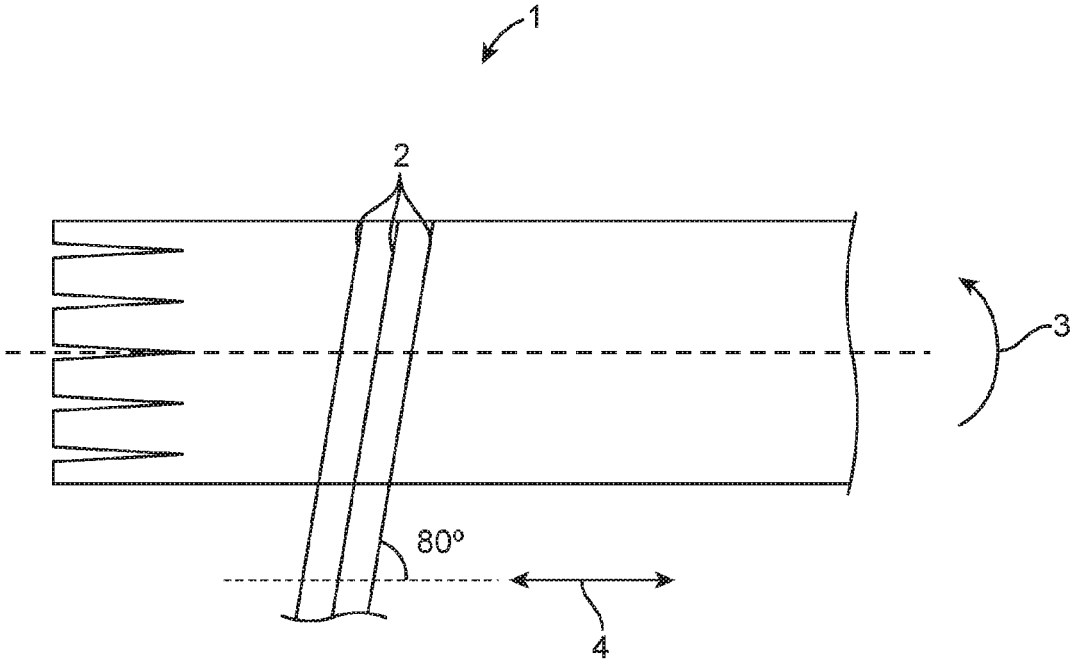
FIG. 6A illustrates two-axis winding of a filamentous composite.
Figure 6B:
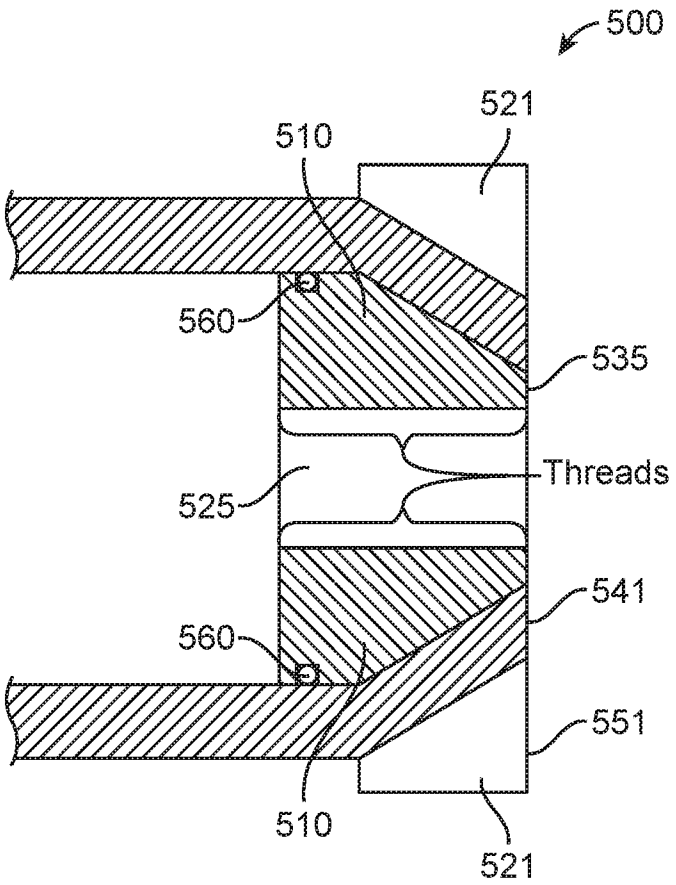
FIG. 6B illustrates the assembled components of a pressure vessel of this invention. A plug of FIG. 2
Figure 6B:
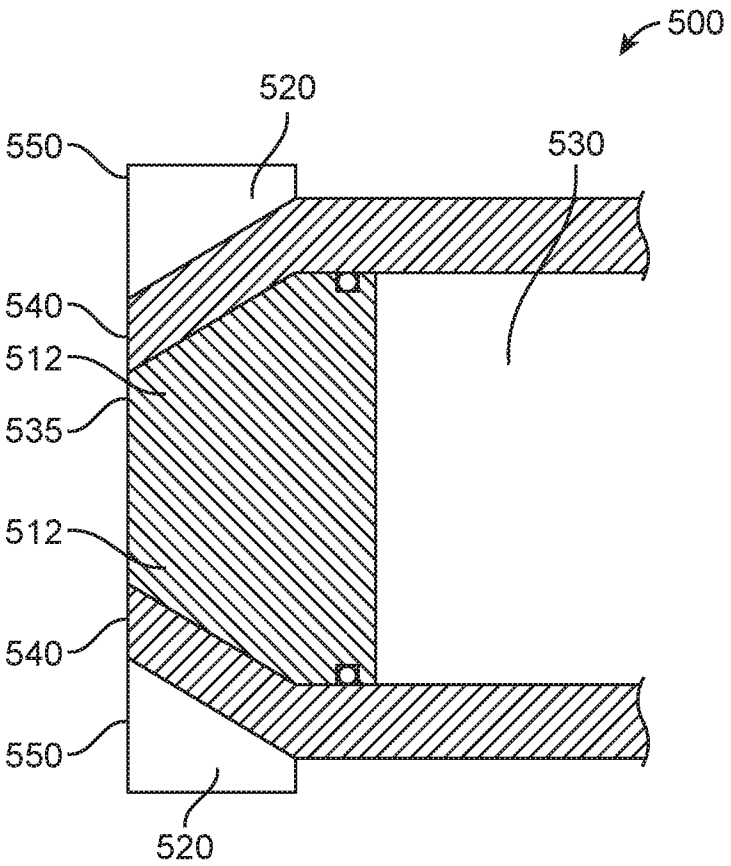

FIG. 6A, as described previously, shows two-axis winding. FIG. 6B show an assembled pressure vessel of this invention comprising pipe 500 comprising plugs 510 and 512, wherein plug 510 further comprises threaded port 525 and plug 512 is a solid construct, and compression caps 520 and 521, which together form the two ends of a pressure vessel of this invention. Plug 510 is shown in FIG. 6B with threaded port 525 for connection with an external fluid ingress/egress control device. It is inserted into bore 530 of pipe 500 until distal end 535 of plug 510 is coplanar with end 541 of pipe 500. The same juxtaposition of elements applies to plug 512 and end 540 of pipe 500. Compression cap 521 is then forced over pipe 500 until distal end 551 of compression cap 521 is coplanar with distal end 535 of plug 510 and distal end 541 of pipe 500. The relationship of end 535 of plug 512 with the end of compression cap 520 and end 540 of pipe 500 is the same.

If compression cap 521 comprises the hemispherical construct 400 of FIG. 5 discussed above, it is simple positioned over pipe until the distal ends of the hemispheres are essentially coplanar with the distal ends of the plug and the pipe and then it is bolted down to effect bending of the pipe and formation of one complete end of a pressure vessel of this invention.

Figure 6C:
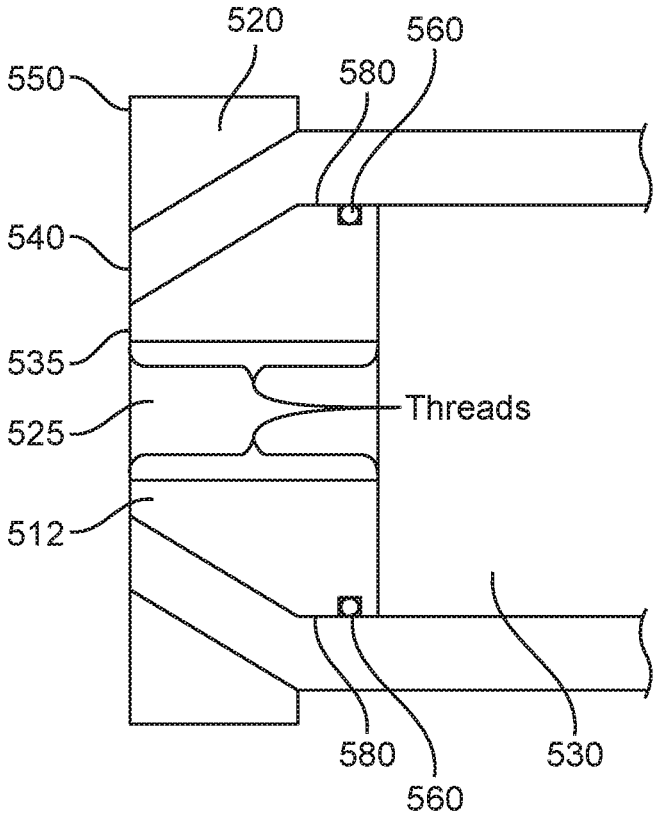
FIG. 6C illustrates one end of a pressure vessel hereof that comprises an adhesive layer.

FIG. 6C shows one end of a pipe or pressure vessel of this invention in which adhesive 580 is interposed between the inner wall of the pipe and the cylindrical surface of plug 512. Plug 510 at the other end of the pipe can be treated similarly.

Figure 7:
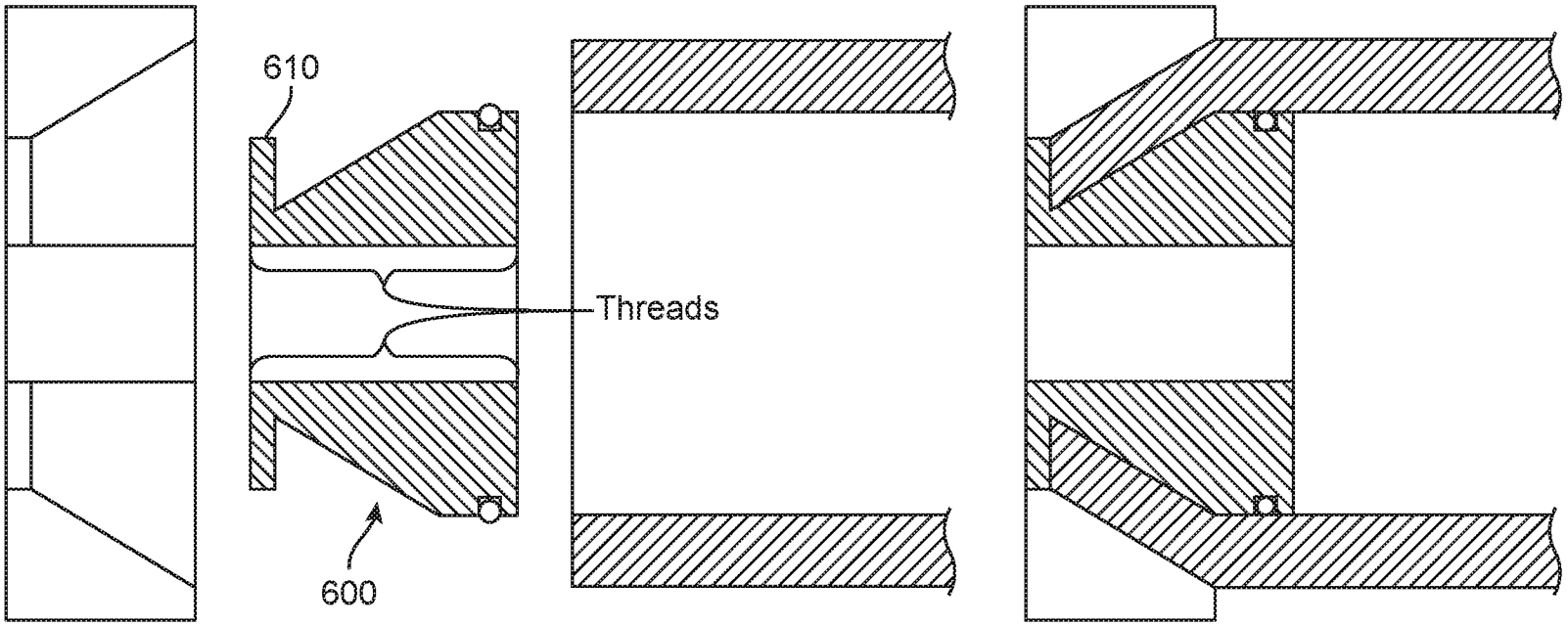
FIG. 7 illustrates the same component assembly as in FIG. 5 but using a flanged plug of FIG. 3 to show how the flange acts as a stop when the plug is inserted into the composite cylinder.

FIG. 7 is similar to FIG. 6 but shows the assembly of the three components of the closure when plug 600 comprises flange 610. As can be seen, inclusion of the flange virtually assures that the plug will be properly positioned to result in a final construct in which the tapered sections of the plug and the compression cap align and the petals at the end of the pipe (not shown) are bent and aligned with the tapers of the plug and the compression cap.

Figure 8:
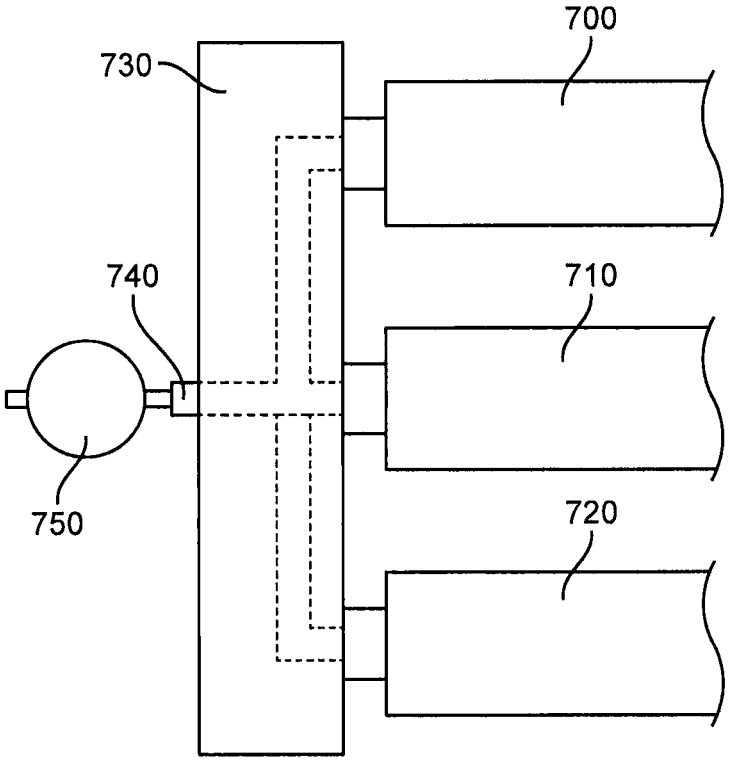
FIG. 8 illustrates an exemplary fluid delivery device comprising three pressure vessels of this invention coupled to a manifold with a single fluid inlet/outlet.

FIG. 8 illustrates an application of the pressure vessels of this invention. Three such pressure vessel, 700, 710 and 720 are shown coupled with manifold 730 which has single port 740 that can be coupled to pressure regulator 750. The pressure regulator can then be coupled to a mouthpiece or mask to form a SCBA or SCUBA. Such an apparatus would, based on the disclosures, be substantially lighter, provide much greater volumetric capacity and therefore markedly enhanced breathing time and have a comparatively very small profile compared to current apparatuses of this nature.

It should be noted that, while the discussion herein has been primarily directed to pressure vessels for the containment of breathable gases for use in SCBA and SCUBA gear, there is no limit on the type of fluid that can be contained in the pressure vessels herein. Of course, depending on the particular fluid and its properties, judicious selection of materials, in particular liner materials for use with that fluid will have to be made. The construction of the pressure vessel will, however, follow be same course and give a pressure vessel that is substantially the same as those described in detail above.

As mentioned previously herein, in general one end of a pressure vessel of this invention comprises a plug comprising a threaded port while the other end of the pressure vessel comprises a solid plug. It is, however, understood that, if for some reason such is desired, the plugs at both ends of the pressure vessel may comprise threaded ports.

The pressure vessels disclosed herein are all described as comprising a filamentous composite as the primary force absorbing entity of the vessel. If, on the other hand, a liner is used in constructing the pressure vessel, it is possible, and is an embodiment herein, to wind a dry filamentous material around the liner in exactly the same manner as a filamentous composite is wound. The properties of the dry-wound material would be essentially the same as those of the composite in that it is primarily the filaments and not the polymeric matrix of the composite that absorbs the forces created by the fluid in the pressure vessel. Such a dry-wound pressure vessel may be used as such or, and it is presently preferred that it be so, a protective layer, that neither impregnates nor embeds the filamentous material may be applied over the filamentous material.

What is claimed:

1. A pressure vessel, comprising:

a pipe having a proximal end, a distal end, a cylindrical section comprising a two-axis wound filamentous composite, a wall that defines a bore, the bore having an inside diameter in the cylindrical section, and a length that, together with the inside diameter, defines a volume, and the pipe having an outer surface; wherein each end of the pipe is inwardly tapered such that a diameter of the bore at each end of the pipe is smaller than the inside diameter;

a plug in the bore at each end of the pipe, each plug comprising a cylindrical section at its proximal end, the cylindrical section being innermost in the bore and contiguous with a section of the wall of the pipe in the cylindrical section of the pipe and an inwardly tapered section at it distal end that is contiguous with the wall of the tapered section of the pipe, the tapered section of the plug terminating in a surface located at or near the end of the pipe; wherein:

the cylindrical section of the plug includes a circumferential groove in which is disposed a seal;

a compression cap at each end of the pipe, each compression cap having an inner surface, and each compression cap comprising a cylindrical section that is disposed over and contiguous with a portion of the outer surface of the cylindrical section of the pipe and a tapered section, the inner surface of the tapered section of the compression cap being contiguous with the outer surface of the tapered section of the wall of the pipe; wherein at least one of the plugs comprises a threaded port for fluid ingress and egress.

2. The pressure vessel of claim 1, where the angle at which the filamentous composite is wound is about 5° to about 85° in relation to a center line of the pipe.

3. The pressure vessel of claim 2, wherein the angle at which the filamentous composite is wound is about 20° to about 85°.

4. The pressure vessel of claim 1, wherein the pipe comprises a liner.

5. The pressure vessel of claim 4, wherein the liner comprises a material selected from the group consisting of a thermoplastic polymer, a thermoset polymer, a ceramic, a metal and combinations of these.

6. The pressure vessel of claim 5, wherein the liner comprises a metal.

7. The pressure vessel of claim 6, wherein the metal liner has been subjected to autofrettage.

8. The pressure vessel of claim 1, wherein the distal end of the plug comprises a flange extending orthogonally outward from a centerline of the plug for a distance that is the same or slightly less than the thickness of the wall of the pipe.

9. The pressure vessel of claim 1, wherein the taper of the plug and of the compression cap is inward at an angle of 5° to 45°.

10. The pressure vessel of claim 1, wherein the taper of the plug and of the compression cap is inward at an angle of approximately 10°.

11. The pressure vessel of claim 1, wherein the inside diameter of the cylindrical section of the pipe is 18 inches or less.

12. The pressure vessel of claim 1, wherein the inside diameter of the cylindrical section of the pipe is 6 inches or less.

13. The pressure vessel of claim 1, wherein the filamentous composite comprises a filament selected from the group consisting of a glass filament, a ceramic filament, a carbon filament, an aramid filament, a natural filament, an ultra-high molecular weight polyethylene filament and combinations thereof.

14. The pressure vessel of claim 13, wherein the filamentous composite comprises a matrix polymer.

15. The pressure vessel of claim 14, wherein the matrix polymer is a thermoset polymer.

16. The pressure vessel of claim 15, wherein the thermoset polymer is selected from the group consisting of epoxy resins, polyester resins, vinyl ester resins, polyimide resins, dicyclopentadiene resins, and combinations thereof.

17. The pressure vessel of claim 1, wherein the plug is fabricated of a material, the material being a metal, an alloy, a polymer, a polymeric composite or a combination of these.

18. The pressure vessel of claim 17, wherein the cylindrical surface, the tapered surface or both the cylindrical and tapered surface of the plug is knurled.

19. The pressure vessel of claim 1, comprising an adhesive layer between the cylindrical surface of the plug and the inner surface of the cylindrical section of the wall of the pipe.

20. The pressure vessel of claim 1, wherein the compression cap is fabricated of a material, the material being a metal, an alloy, a polymer, a polymeric composite or a combination of these.

21. The pressure vessel of claim 1, wherein the fluid comprises a gas, a liquid or a combination thereof.

* * * * *